US009470079B1

(12) United States Patent
Schmidt et al.

(10) Patent No.: US 9,470,079 B1
(45) Date of Patent: Oct. 18, 2016

(54) HIGH ENERGY GAS FRACTURING DEVICE

(71) Applicant: The GasGun, Inc., Clackamas, OR (US)

(72) Inventors: Jaia D. Schmidt, Happy Valley, OR (US); Adam C. Schmidt, Happy Valley, OR (US); Richard A. Schmidt, West Linn, OR (US)

(73) Assignee: THE GASGUN, INC., Clackamas, OR (US)

( * ) Notice: Subject to any disclaimer, the term of this patent is extended or adjusted under 35 U.S.C. 154(b) by 241 days.

(21) Appl. No.: 14/177,449

(22) Filed: Feb. 11, 2014

(51) Int. Cl.
*E21B 43/263* (2006.01)
*F16L 9/02* (2006.01)

(52) U.S. Cl.
CPC ..... *E21B 43/263* (2013.01); *F16L 9/02* (2013.01)

(58) Field of Classification Search
CPC .. E21B 43/263; E21B 43/116; E21B 7/1245; E21B 43/26; E21B 7/007; E21B 29/02; G06Q 30/04
See application file for complete search history.

(56) References Cited

U.S. PATENT DOCUMENTS

| | | | |
|---|---|---|---|
| 1,758,358 | A | 5/1930 | Ennis |
| 2,779,278 | A | 1/1957 | Klotz, Jr. |
| 2,921,519 | A | 1/1960 | Martin |
| 3,174,545 | A | 3/1965 | Mohaupt |
| 3,270,668 | A | 9/1966 | Silver |
| 3,707,914 | A | 1/1973 | Land |
| 4,160,412 | A | 7/1979 | Snyer et al. |
| 4,184,430 | A | 1/1980 | Mock |
| 4,290,486 | A | 9/1981 | Regalbuto |
| 4,329,925 | A | 5/1982 | Hane et al. |
| 4,798,244 | A | 1/1989 | Trost |
| 5,005,641 | A | 4/1991 | Mohaupt |
| 5,005,649 | A | 4/1991 | Smith et al. |
| 5,690,171 | A | 11/1997 | Winch et al. |
| 6,082,450 | A | 7/2000 | Snider et al. |
| 6,494,261 | B1 | 12/2002 | Pahmiyer |
| 6,817,298 | B1 | 11/2004 | Zharkov et al. |
| 6,991,044 | B2 | 1/2006 | Zhang et al. |
| 7,228,907 | B2 | 6/2007 | Schmidt et al. |
| 7,389,916 | B2 | 6/2008 | Chirnomas |
| 7,430,529 | B2 | 9/2008 | Erb et al. |
| 2002/0065759 | A1 | 5/2002 | Boies et al. |
| 2003/0155112 | A1 | 8/2003 | Tiernan et al. |
| 2003/0155125 | A1 | 8/2003 | Tiernan et al. |
| 2005/0066836 | A1 | 3/2005 | Levi |
| 2007/0094368 | A1 | 4/2007 | Erb et al. |
| 2007/0200664 | A1 | 8/2007 | Proska et al. |
| 2008/0103948 | A1* | 5/2008 | Schimdt ..... G06Q 30/04 705/34 |

FOREIGN PATENT DOCUMENTS

| | | |
|---|---|---|
| WO | 02/063133 | 8/2002 |

* cited by examiner

*Primary Examiner* — Yong-Suk (Philip) Ro
(74) *Attorney, Agent, or Firm* — Timothy E. Siegel Patent Law, PLLC; Timothy E. Siegel

(57) ABSTRACT

A low profile high energy gas fracturing device, comprising a closed steel tube having a uniform wall thickness, except for having thinned areas that are designed to rupture when subjected to pressure greater than a predetermined level. Propellant is packed into the said steel tube sufficient to create high pressure above said predetermined level, when ignited. Finally, an ignition mechanism passes through said tube, to ignite the propellant.

20 Claims, 5 Drawing Sheets

HIGH ENERGY GAS FRACTURING DEVICE

BACKGROUND

Deposits of valuable fluids, such as crude oil, natural gas and even water, frequently occur in geologic formations having limited permeability. Although the initial perforating of the sides of an oil well typically opens up this type of deposit for initial exploitation, the well may soon experience a drop in production and require further treatment. To address this situation, a number of different fracturing techniques have been developed including explosive fracturing, hydraulic fracturing and high energy gas fracturing (HEGF). Each of these techniques is designed to fracture the underground geologic formation, thereby increasing permeability.

HEGF appears to have an advantage over the other fracturing techniques when certain conditions exist in a well. Test observations have shown that HEGF can create several radially extending fractures, thereby increasing the chance of significantly increasing permeability of nearby rock.

One type of HEGF uses a propellant that must be kept dry and contained during combustion. In this version, a strong container bearing a charge of propellant (i.e. a low explosive) is lowered into a partially liquid filled well and the propellant is ignited. The container keeps the charge dry and constrains it to obtain the full explosive force.

One type of propellant container that has been used is a steel tube defining a series of apertures, each capped. When the propellant is ignited the caps are blown off and the propellant, now in gaseous form, pours out of the apertures and fractures the rock sides of the well, thereby creating fissures through which oil can flow.

Unfortunately, the protruding caps made this mechanism too thick to fit into some narrow wells. Wells that are too narrow to accept the 3.375 inch profile of the original HGEF device offered previously are found in Mexico and other developing countries, and in the United States, when a portion of a tube mechanism in a well (associated with a sucker pump) the upper part of well cannot be removed, or is too long to be removed economically, it is impossible to use a 3.375 inch profile device. Narrowing the tube to permit clearance for the caps reduces the volume of the tube to the point where the effectiveness is reduced. The thickness of the steel is necessary to resist the expansive forces of the propellant, once ignited.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a low profile high energy gas fracturing device, comprising a closed steel tube having a uniform wall thickness, except for having thinned areas that are designed to rupture when subjected to pressure greater than a predetermined level. Propellant is packed into the steel tube sufficient to create high pressure above the predetermined level, when ignited. Finally, an ignition mechanism passes through the tube, to ignite the propellant.

In a second separate aspect, the present invention may take the form of a method of fracturing a narrow well that is partially filled with water. The method makes use of a low profile high energy gas fracturing device, which includes a closed steel tube having a uniform wall thickness, except for having thinned areas. Propellant is packed into the steel tube, an ignition mechanism passes through the tube, to ignite the propellant and a line wire extends from the tube, and is in electrical contact to the ignition mechanism. This device is passed into the narrow well until it is submerged in the water and a signal is transmitted through the line wire to activate the ignition mechanism, causing it to ignite the propellant, thereby creating pressure inside the tube sufficient to rupture the tube at least at some of the weakened area, thereby permitting gas to escape at a high energy.

In a third separate aspect, the present invention may take the form of a round steel tube, including a circular wall, having a sequence of holes formed in its exterior, extending partially through the circular wall.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Figure 1:
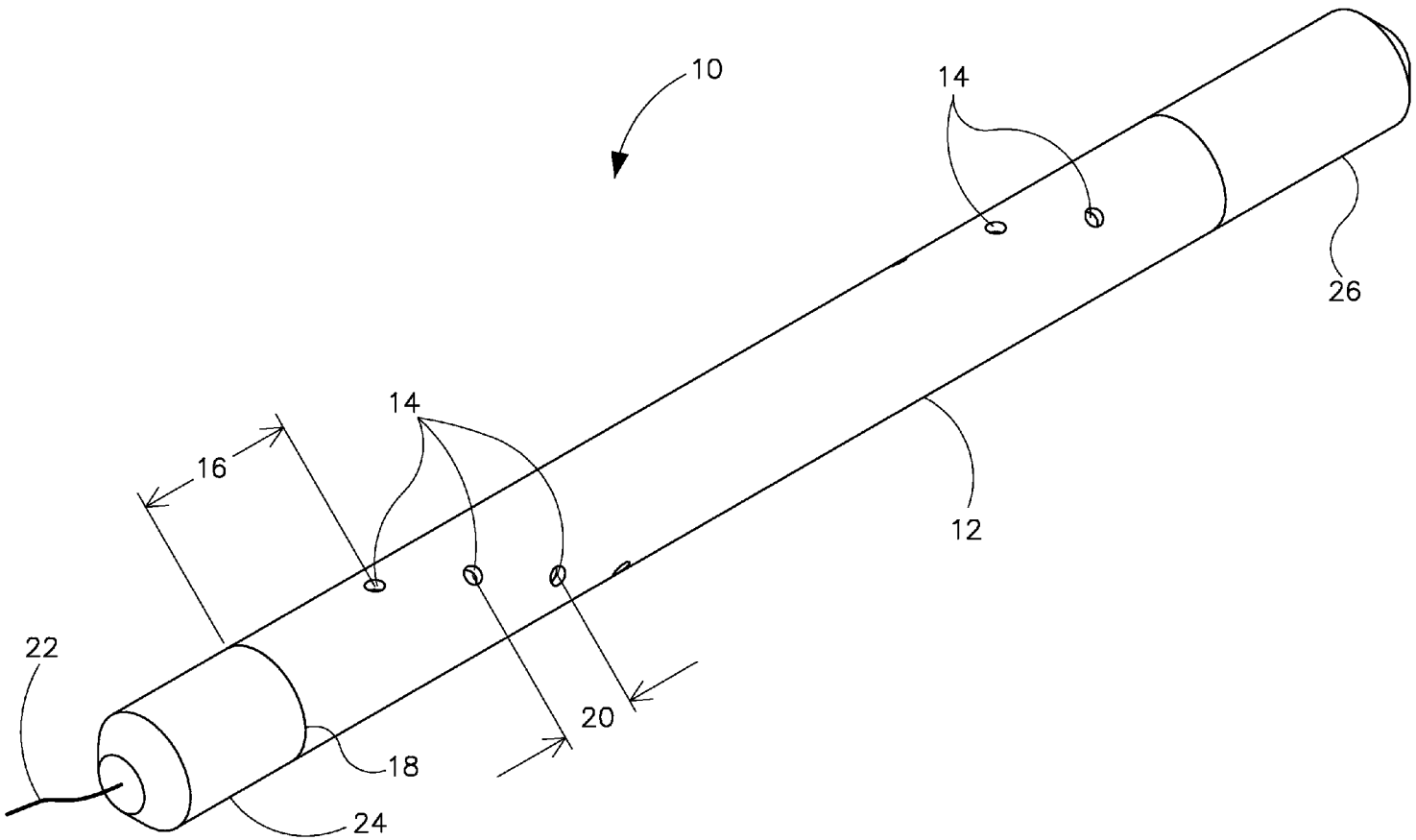
FIG. 1 is an isometric view of a high energy gas fracturing cylinder, according to the present invention.

Referring to FIG. 1, in a preferred embodiment a high energy gas fracturing device 10 is comprised of a steel tube 12, having an inner diameter of 1.610 inches and an outer diameter of 2.03 inches, narrow enough to fit into a narrow well. A set of weakened areas 14 forms a helix about tube 12. The wall thickness of tube 12 is generally 0.21 inches, but each weakened area 14 is created by machining a hole to a depth of 0.175 inches into the exterior of tube 12, resulting in a weakened area 14 wall thickness of 0.035 inches.

A top-most weakened area 14 has a center that is a length 16 of six inches from a top-end 18 of tube 12. Weakened areas 14 have center-to-center spacing 20 of 3.281 inches in the longitudinal dimension, and of 20 degrees, which translates to 0.156 inches, in the circumferential dimension. Each weakened area 14 is round and has a diameter of 0.75 inches. The weakened areas 14 extend over almost a meter. In an alternative preferred embodiment, the tube is longer and the weakened areas 14 extend over a two meter length. A line wire 22, typically extending through the well to an electrical signal producing device at the well top, extends into tube 12. A top cap or plug 24 covers the top of tube 12 and a bottom cap or bull plug 26 covers the bottom.

Figure 2:
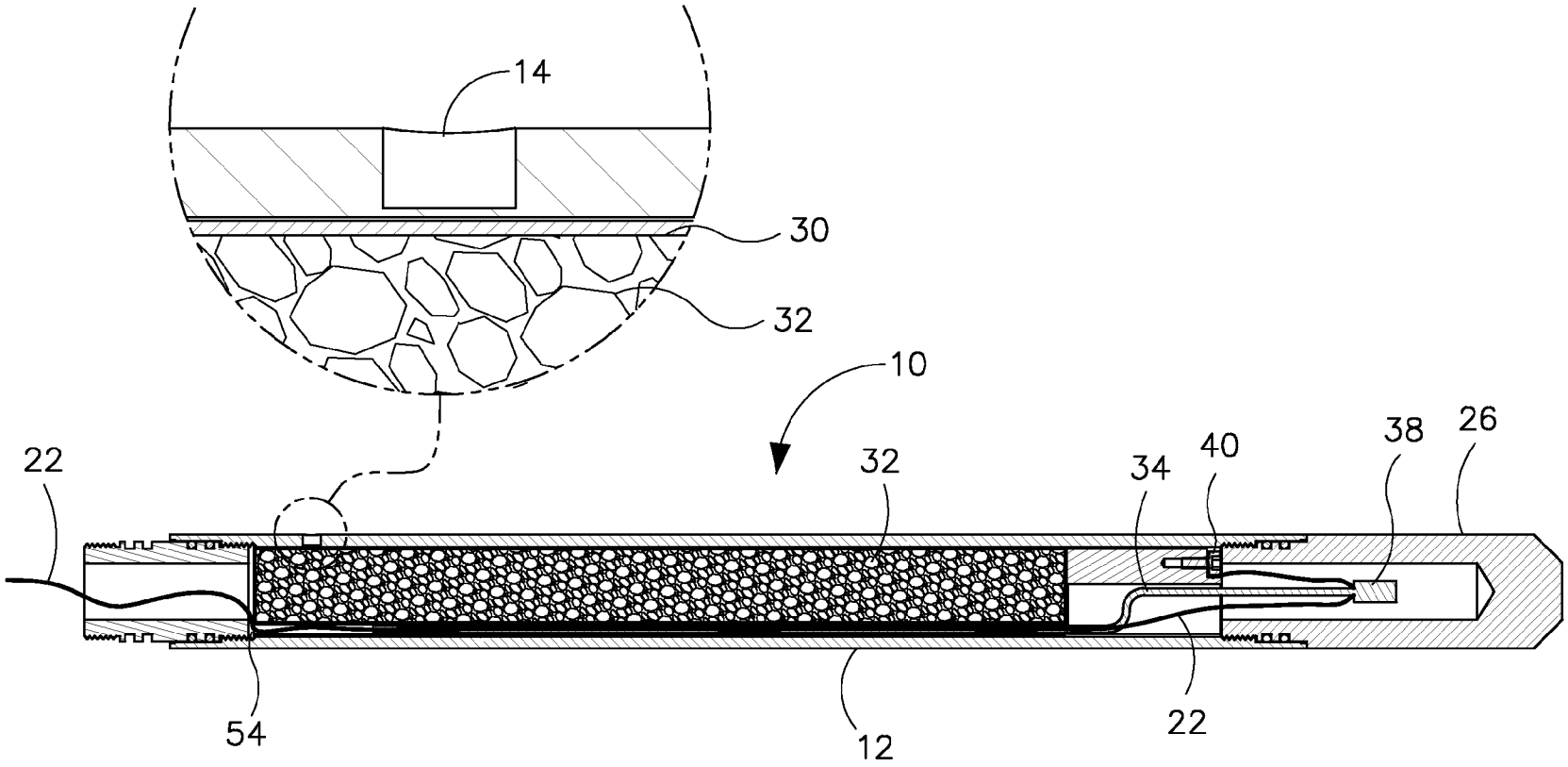
FIG. 2 is a longitudinal sectional view of the cylinder of FIG. 1, showing a detail view of a weakened area.
Figure 3:
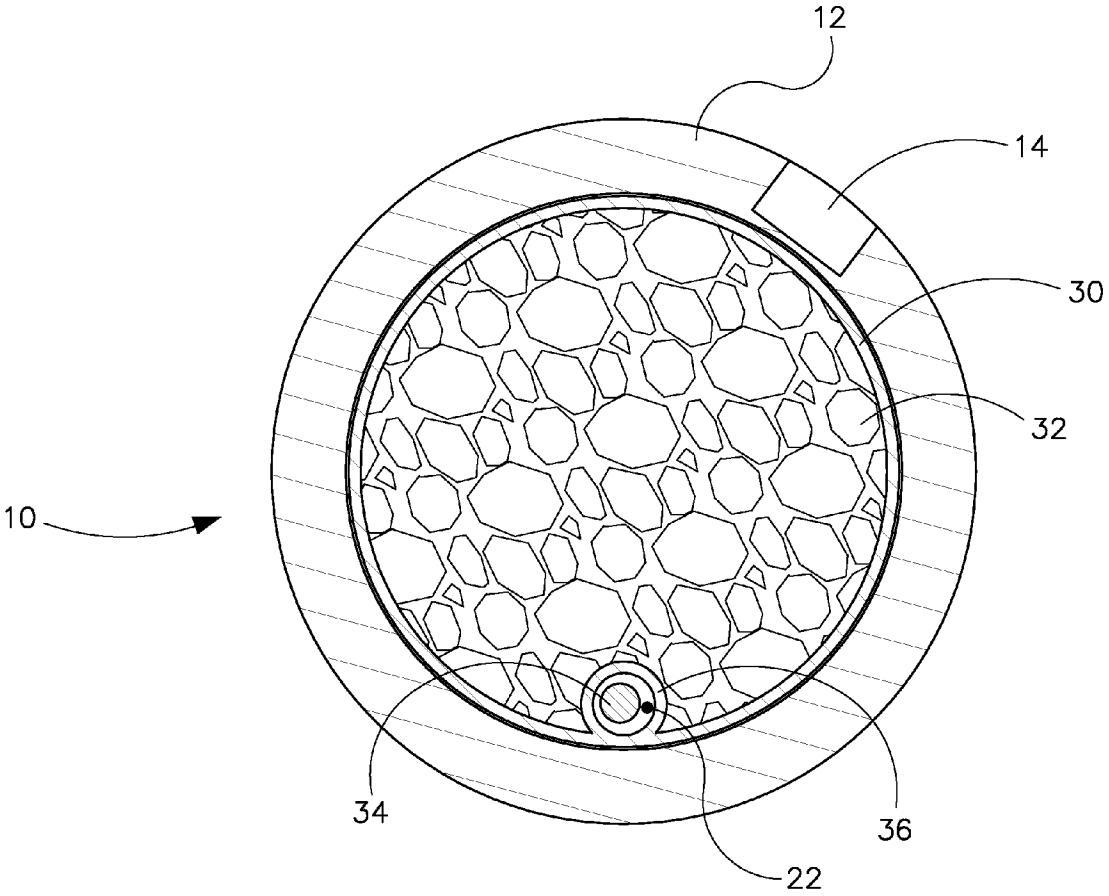
FIG. 3 is a cross-sectional view of the cylinder shown in FIG. 1.

Referring to FIGS. 2 and 3, tube 12 encloses a tubular carton 30 packed with propellant 32 (also referred to in some literature as "low explosive"). The line wire 22 and an ignition cord 34 extend through a thin tube 36 defined by carton 30, at its side. Carton 30 facilitates the placement of propellant into tube 12, together with line wire 22 and the ignition cord 34, which otherwise might prove an encumbrance, as they would have to be passed through before tube 12 would be filled with propellant, and the propellant would tend to damage these elements, as it was poured into tube 12.

And blasting cap 38 permits an electrical pulse through the line wire 22, connected to a ground 40, to ignite the ignition cord 34. The end cap 26 ("bull plug" in industry parlance) closes the end of tube 12, and protects the blasting cap 38.

Figure 4:
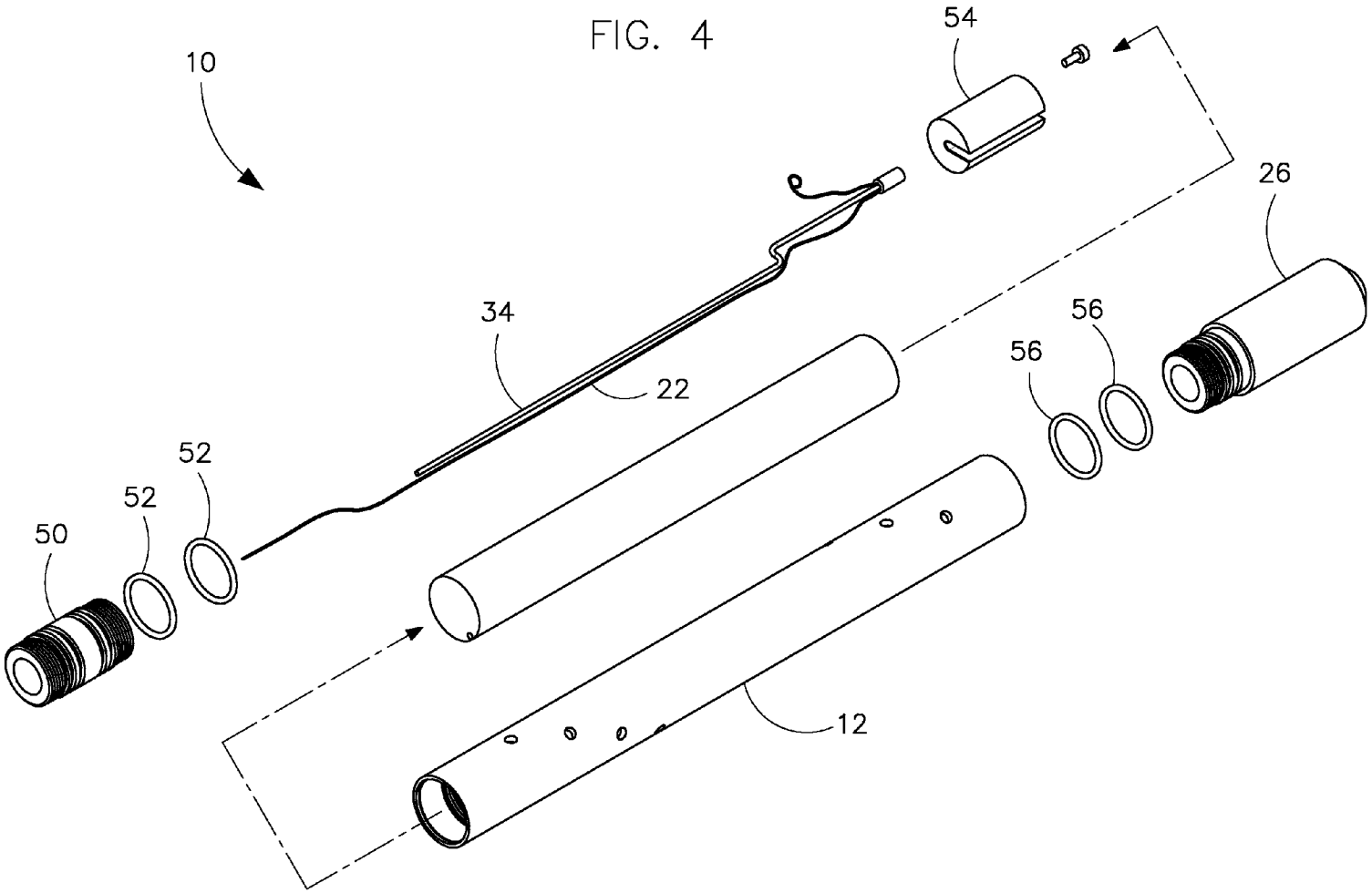
FIG. 4 is a exploded view of the cylinder of FIG. 1.
Figure 5:
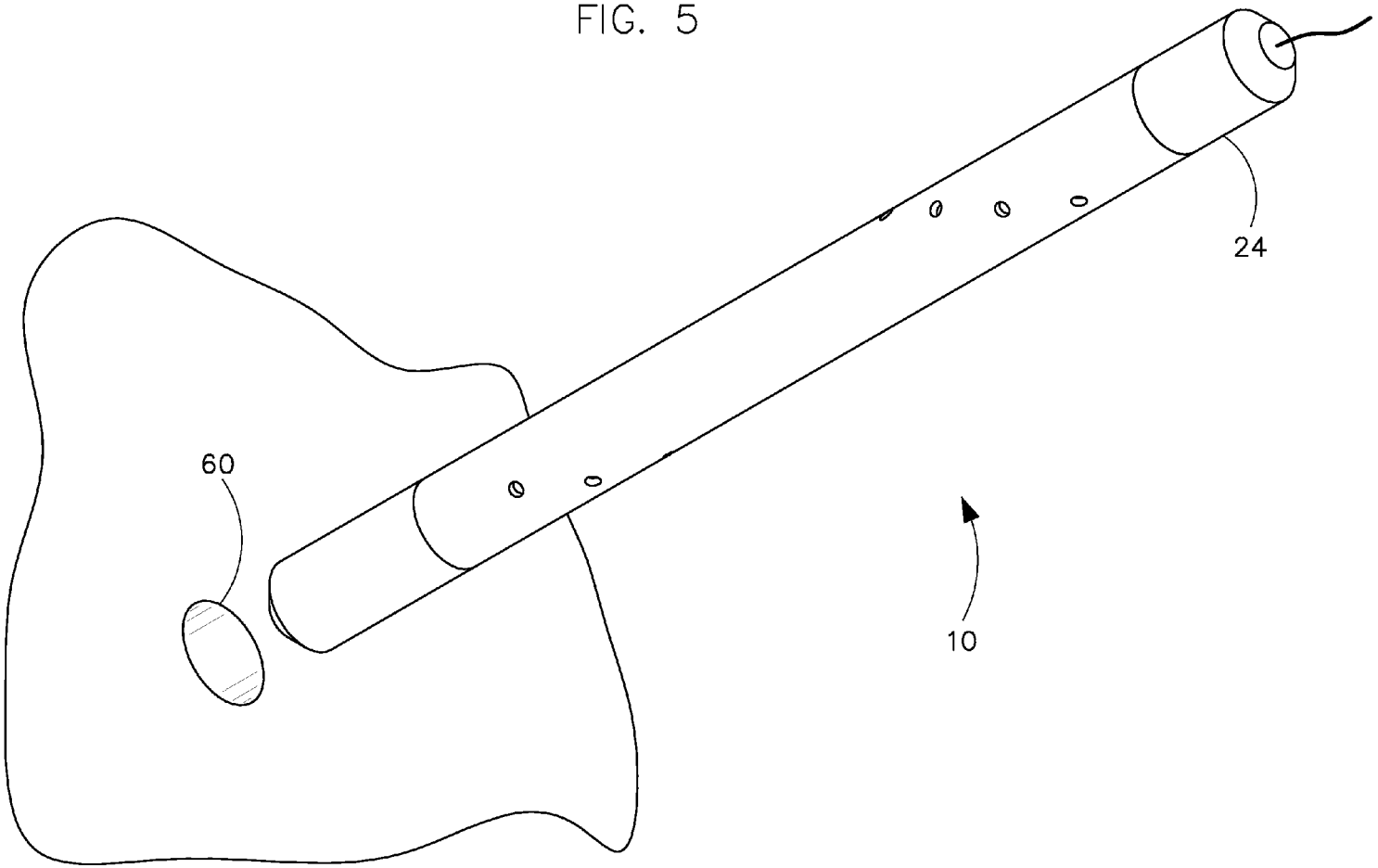
FIG. 5 is an isometric view of the cylinder of FIG. 1, as it is lowered into a well.

Referring now to FIG. 4, a top joining element 50, permits attachment of another unit, such as device 10, for a longer section of well revitalization, or the top plug 24 (FIGS. 1 and 5). A pair of top O-rings 52 seal the top joining element 50 to tube 12. A soft steel spacer 54 permits line wire 22 to extend into the interior tube 12. Finally a bottom pair of O-rings 56 seal tube 12 to bottom cap 26. Referring to FIG. 5, device 10 is lowered into a well 60. It may then be lowered thousands of feet, until it is covered with water.

The device 10 is lowered into the liquid, to a depth of at least 91 meters (300 ft). It should be noted that although 91 meters (300 ft) generally serves as the minimum depth to which device 10 must be submerged in order to work effectively, it can be made to work even in a dry well, if steps are taken to block the gas produced from the propellant combustion from leaking upwardly or downwardly, away from device 10, once emitted. Moreover, device 10 may be very deeply submerged, to a depth at least on the order of 3,000 meters.

Next, the blasting cap 38 is ignited by the line wire 22, which ignites the ignition cord 34, which ignites all of the propellant 32 within approximately one millisecond. The gasses produced are contained by the column of liquid in the well 60 and burst out rapidly toward the sides of the well 60, where perforations in the well casing are found and transited. The first gas to emerge through the perforations tends to blast debris out of the perforations, while immediately subsequent gas, at an even higher pressure and velocity due to the progressive combustion, opens up new cracks in the geologic formation. The combustion is completed in about 20 milliseconds. The pressure produced by the combustion of the propellant 32 deforms spacer 54, permitting to act as a more effective barrier against the hot gasses, which might otherwise blast off the top cap 24.

Propellant 32 may be either single-based (nitrocellulose), double-based (nitrocellulose and nitroglycerin), or triple-based (nitrocellulose, nitroglycerin, and nitroguanadine). These propellants may be available from BAE Systems, Inc., in Radford, Va.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

We claim:

1. A low profile high energy gas fracturing device, comprising:

(a) a closed steel tube in a well having a uniform wall thickness, except for having thinned areas with blind holes on said thinned areas, which rupture at pressure greater than a predetermined level;

(b) propellant packed into said steel tube sufficient to create said pressure above said predetermined level, upon ignition; and (c) an ignition mechanism passing through said tube, to ignite the propellant.

2. The device of claim 1, wherein said thinned areas are round.

3. The device of claim 1, wherein said thinned areas are evenly spaced, along said tube.

4. The device of claim 1, wherein said thinned areas are evenly spaced, around said tube.

5. The device of claim 1, wherein said propellant is packed into a container that is placed into said tube.

6. The device of claim 5, wherein said container defines a passageway for the ignition mechanism to extend longitudinally along said propellant.

7. The device of claim 6, wherein said passageway is on a side of said container.

8. The device of claim 6, wherein said container is made of a paper product.

9. The device of claim 1, wherein said propellant is taken from the group consisting essentially of nitrocellulose, nitroglycerin or nitroguanidine.

10. The device of claim 1, wherein said uniform wall thickness is greater than 0.1 inches.

11. The device of claim 1, wherein said thinned areas have a wall thickness of less than 0.05 inches.

12. A method of fracturing a well that is partially filled with water, comprising:

(a) providing a low profile high energy gas fracturing device, comprising:

(i) a closed steel tube having a uniform wall thickness, except for having thinned areas with blind holes on said thinned areas;

(ii) propellant packed into said steel tube; and (iii) an ignition mechanism passing through said tube, to ignite the propellant; and (b) providing a line wire extending from said tube, and in electrical contact to said ignition mechanism;

(c) passing said device into said well until said device is submerged in said water; and (d) transmitting a signal through said line wire to activate said ignition mechanism, causing said ignition mechanism to ignite said propellant, thereby creating pressure inside said tube sufficient to rupture said tube at least at some of said thinned areas, thereby permitting gas to escape at a high energy.

13. The method of claim 12, wherein said well is an oil well.

14. The method of claim 12, wherein said well is a water well.

15. The method of claim 12, wherein said well is a gas well.

16. The method of claim 12, wherein said propellant is packed into a container that is placed into said tube.

17. The method of claim 16, wherein said container defines a passageway for the ignition mechanism to extend longitudinally along said propellant.

18. The method of claim 17, wherein said passageway is on a side of said container.

19. The method of claim 12, wherein said uniform wall thickness is greater than 0.1 inches.

20. The device of claim 12, wherein said thinned areas have a wall thickness of less than 0.05 inches.

* * * * *